United States Patent [19]

Lorette

[11] 4,217,575

[45] Aug. 12, 1980

[54] PARTURITION WARNING DEVICES

[76] Inventor: René Lorette, Fleville, 08250 Grandpre, France

[21] Appl. No.: 882,950

[22] Filed: Feb. 28, 1978

[30] Foreign Application Priority Data

Mar. 9, 1977 [FR] France ..... 77 06909
Nov. 7, 1977 [FR] France ..... 77 33384

[51] Int. Cl.[2] ..... G08B 21/00

[52] U.S. Cl. ..... 340/573; 119/1; 128/775

[58] Field of Search ..... 340/573; 128/2 R, 2 S, 128/775; 119/1; 200/DIG. 2, 61.41, 61.7

[56] References Cited

U.S. PATENT DOCUMENTS 3,273,559 9/1966 Evans ..... 128/2 S

FOREIGN PATENT DOCUMENTS 2618821 4/1976 Fed. Rep. of Germany ..... 128/2 R

*Primary Examiner*—Glen R. Swann, III
*Attorney, Agent, or Firm*—Wenderoth, Lind & Ponack

[57] ABSTRACT

A parturition warning device for an animal includes a first member intended for stable location beneath the tail but above the anus of the animal, a second member pivotally attached to the first member, and springs urging the second member against the vulva of the animal. The second member is located to completely cover the vulva of the animal and is arranged to actuate an electrical switch when displaced, away from the vulva, indicative of a positive issue from the vulva in the early stages of birth, to activate an alarm system.

16 Claims, 5 Drawing Figures

PARTURITION WARNING DEVICES

BACKGROUND OF THE INVENTION

This invention relates to a parturition warning device for animals and has particular application to such a device for farm animals such as mares and cows.

It is always desirable, and often essential, to supervise large farm animals giving birth so that the supervising personnel can take such hygiene measures as may be desirable during and after the birth and can intervene when necessary to assist the delivery. A difficulty is that the exact time when delivery will start is difficult to determine in advance and, without a parturition warning device, the supervising staff must be on duty well in advance of the birth and may spend many long and tedious hours of waiting before the animal requires assistance.

Parturition devices are known and in, for example, British patent specification No. 632827 there is disclosed an electric alarm device comprising a contact device adapted to be attached to the mother animal and to be connected to an electric circuit including signal means, the contact device being provided with an operating member extending before the vagina of the mother animal, so as to establish a contact and close the electric circuit at the beginning of the litter, characterized in that the operating member of the contact device comprises a brace pivotably mounted on a contact casing adapted to be attached to the mother animal, such brace being resiliently held against the vagina of the mother animal and the arms of the brace being spaced apart, so as to permit urine and faeces of the mother animal to escape freely therebetween, the contacts in the contact casing being closed when the brace is turned upwards by the matter extruded from the vagina at the beginning of the litter.

A serious disadvantage of this prior art construction is that the arms of the brace are spaced apart at the level of the vagina and the amniotic sac can become wedged between the arms or, if the sac is pierced, the paws or feet of the animal being born can become wedged between the arms or pass one on either side of one or both arms. In such a case damage to the sac or the young animal may take place before the warning device is actuated.

In a more recently proposed parturition warning device a body is introduced into the vagina of the animal and, when the animal is erect and the body is expelled by the amnoiotic sac, the body falls downwardly to actuate the warning device. A disadvantage with this device is that, when the pregnant animal is lying, the body is expelled substantially at right angles to the intended path and the warning device is not actuated thereby.

SUMMARY OF THE INVENTION

The present invention seeks to provide a simple and reliable parturition warning device.

According to the present invention there is provided a parturition device for an animal comprising a first member adapted for stable location beneath the tail but above the anus of the animal, a second member depending from the first member and displaceable relative thereto, the second member, when operable, being located to completely cover the vulva of the animal, resilient means between the first member and the second member intended to urge the second member towards the vulva, and an electrical switch arranged to be actuated, by a displacement of the second member away from the vulva indicative of a positive issue from the vulva in the early stages of the birth, to activate an alarm system.

Preferably the device includes a crupper strap, and in one such embodiment of the invention the first member is attached to that part of the strap intended to be located beneath the tail of the animal.

In an alternative embodiment the first member forms that part of a crupper strap intended to be located beneath the tail of the animal.

Preferably the electrical switch is mounted on the first member.

The second member is preferably displaceable relative to the first member about a pivotal axis and the resilient means may conveniently comprise a coil spring concentric with the pivotal axis. The ends of the coil spring may conveniently extend as straight limbs, one limb being arranged to engage the second member and the other limb engaging an actuating member for the electrical switch, the arrangement being such that pivotal displacement of the second member away from the vulva increases the tension in the spring and thereby the force applied to the actuating member for the switch.

In one embodiment in accordance with the invention the second member is arranged to cover both the vulva and the anus of the animal. In an alternative embodiment the second member comprises a vulva covering member supported from the first member by two substantially parallel arms.

When the second member comprises a vulva covering member, and whereby the anus of the animal is not covered by the second member, the location of the vulva covering member is conveniently adjustable relative to the first member in the length direction of the arms to permit the device to be adjusted for different animals. Preferably the vulva covering member has a chamfered, curved, or otherwise reduced upper edge to discourage the deposit of excrement on the member, and in a preferred embodiment the vulva covering member presents a concave surface to the vulva and is so shaped as to make pressure contact with the perineal region of the animal to avoid entry of excrement between the vulva covering member and the animal. It will thus be seen that when the second member is limited to a vulva covering member the device offers no obstruction to normal excretion and little obstruction to the passage of urine.

Alternatively, and preferably when the second member covers both the anus and the vulva, the second member includes means for attachment to the upper regions of the tail of the animal so that when the animal naturally lifts its tail to excrete or urinate the second member is displaced away from such discharge and returns when the animal lowers its tail.

The second member may conveniently be made from a rigid, solid or perforated, metal or plastics material.

A positive issue from the vulva in the early stages of the birth intended to activate the electrical switch always causes the animal to lift its tail and retain the tail elevated so that, when the second member is attached to the tail, the electrical switch will operate. When the second member is not attached to the tail, or the tail is not lifted sufficiently to cause the second member to hold the switch actuated for a sufficient period to operate the alarm system, the second member is positively displaced by the issue from the vulva, which issue will comprise the amniotic sac, or the paws or feet of the young animal if the sac has burst prematurely. To assist operation of the second member by direct positive issue from the vulva an insert member may be inserted into the vagina of the animal so as to be displaced, to engage and bring the second member to a switch operating position, as the amniotic sac moves down the vagina. Preferably the insert is of such dimensions that the second member is displaced to a switch actuating position only after the amniotic sac has moved a predetermined distance down the vagina indicative of the positive start of the delivery.

Preferably, such an insert member comprises a cylindrical body with hemispherical ends of such dimensions as to fill the vaginal cavity without risk of expulsion by vulva contractions, and the insert may conveniently comprise a resilient body covered by an impermeable skin or film to facilitate cleaning and sterilization.

The electrical switch of the device is intended to complete an electrical circuit for an alarm arrangement which preferably includes a visual alarm and/or an audible alarm.

It will be appreciated that when the second member attaches to the tail of the animal, the second member may be displaced to actuate the electrical switch each and every time the animal lifts its tail. Further, when the second member covers only the vulva and is not attached to the animal's tail the forceful issue of urine may again cause the second member to displace to operate the electrical switch.

To avoid such false alarms the alarm circuit preferably includes a delay device, intended to allow the alarm arrangement to become fully functional to operate the visual and/or audible alarm only after the electrical switch has closed, and remained closed, for a predetermined period, which period will preferably exceed the time period the animal will lift its tail to excrete or urinate.

BRIEF DESCRIPTION OF THE DRAWINGS

The invention will now be described further by way of example with reference to the accompanying drawings in which.

DETAILED DESCRIPTION OF THE INVENTION

Figure 1:
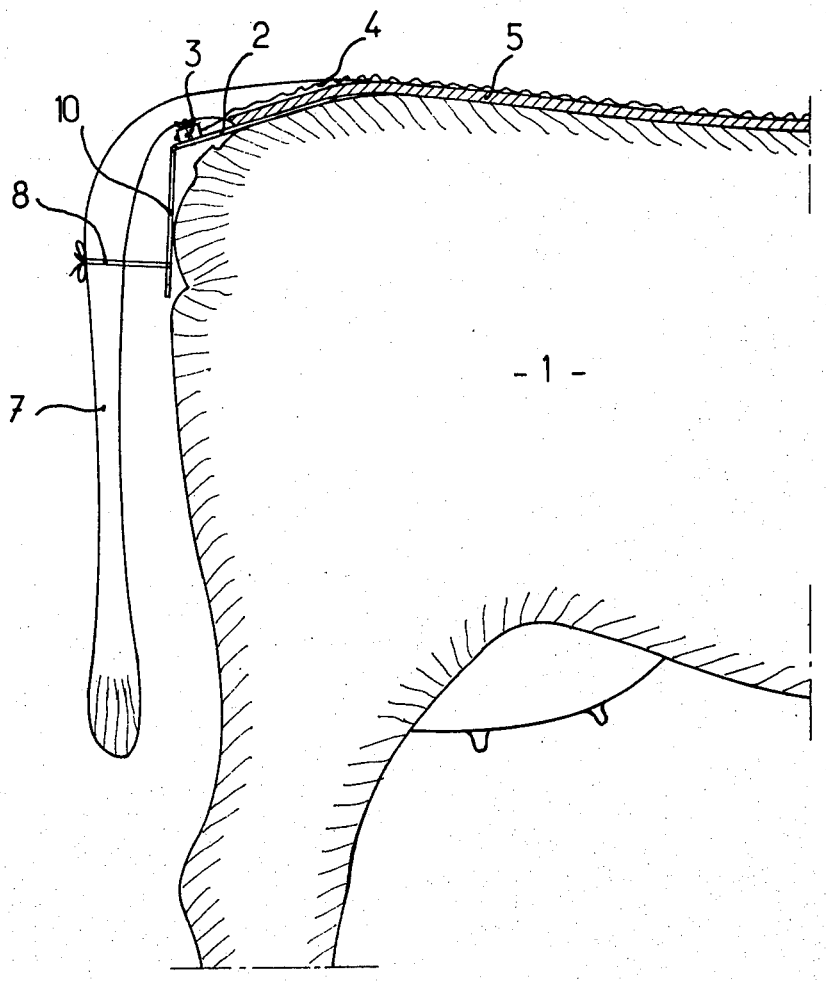
FIG. 1 shows a diagrammatic side view of a cow fitted with a parturition warning device in accordance with the invention.
Figure 2:
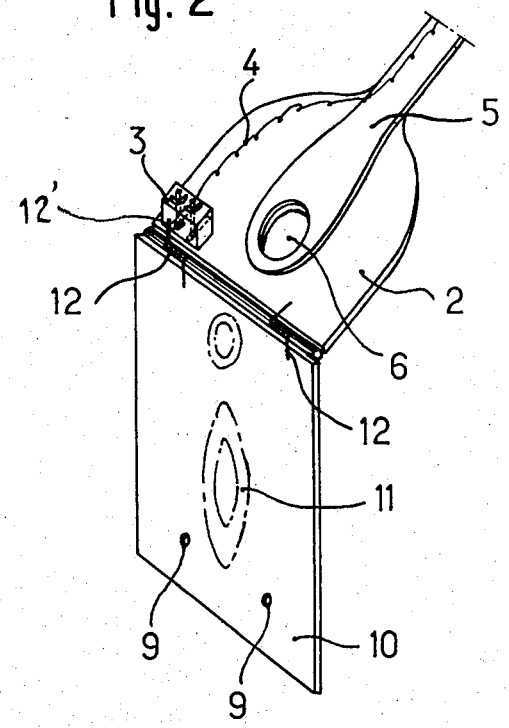
FIG. 2 shows a perspective diagrammatic view of the device shown in FIG. 1.
Figure 3:
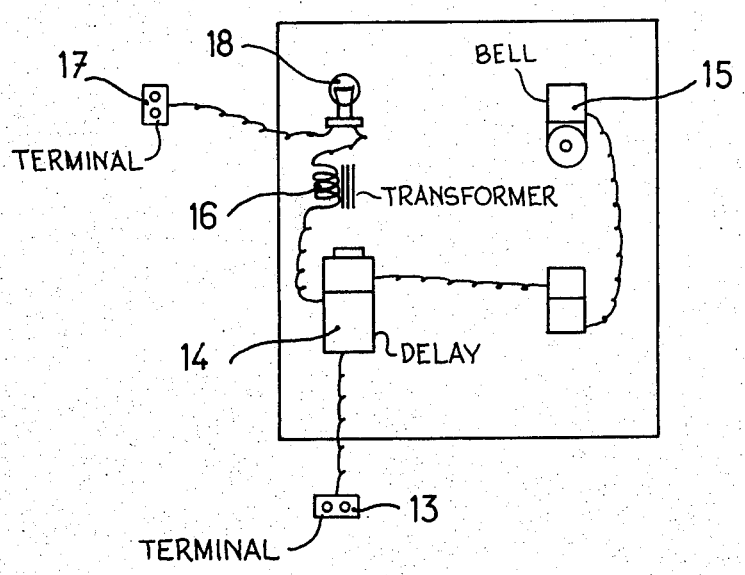
FIG. 3 shows a diagrammatic view of an alarm arrangement operable by the device shown in FIGS. 1 and 2.

In the arrangement shown in FIG. 1 a cow, designated 1 and shown in a standing position, has a first member 2 attached thereto, and member 2 supports an electrical switch 3 connected by conductors 4 to an alarm arrangement (to be described hereinafter with reference to FIG. 3). The first member 2 is tightly fastened on the rump of the animal by a crupper strap 5, which includes (see FIG. 2) a hole 6 through which the tail 7 of the animal passes. The tail 7 is secured to a second member 10 by a strap 8 passing through holes 9 in second member 10. The member 10 is pivotably attached to the first member 2 and, in this embodiment the member 10 normally covers both the anus and vulva 11 (see FIG. 2) of the animal 1. As seen in FIG. 2, the device includes two coil springs 12 concentric with the pivotal axis between members 2 and 10, and the ends of springs 12 extend as straight limbs. One limb of each spring 12 acts on the member 10, the other limb of one spring 12 acts against the member 2, and the other limb of the other spring 12 acts upon an actuating member for the switch 3. Thus, the springs 12 urge rotation of the member 10 against the animal and the limb of the spring 12 engaged with the switch 3 actuates switch 3 when the displacement of member 10 increases the force applied to the actuating member of the switch 3 above a predetermined value.

The conductors 4 from switch 3 connect via a terminal 13 (FIG. 3) with a delay device 14 in the circuit for the alarm arrangement, and this arrangement includes a low-tension bell 15 powered by a transformer 16 whose lead to a terminal 17 of the system includes a pilot lamp 18. The delay device 14, which may comprise any suitable timer or slow-to-operate relay, completes the circuit to operate the bell only after a predetermined period of time which is much longer than the normal time for defecation, even when difficult, of the animal. Thus, triggering of the bell is avoided when the animal raises its tail for a short time, and false alarms are thereby avoided.

On the other hand, when the delay device 14 has been activated as a result of a continued prolonged displacement of the second member 10 by protrusion of the amniotic sac or the young from the vulva or in the event of a long-term raising of the tail occurring in conjunction with uterine contractions, the device 14 will operate to allow the alarm to become effective and the supervising personnel, warned by the bell 15, may then attend the animal.

Figure 4:
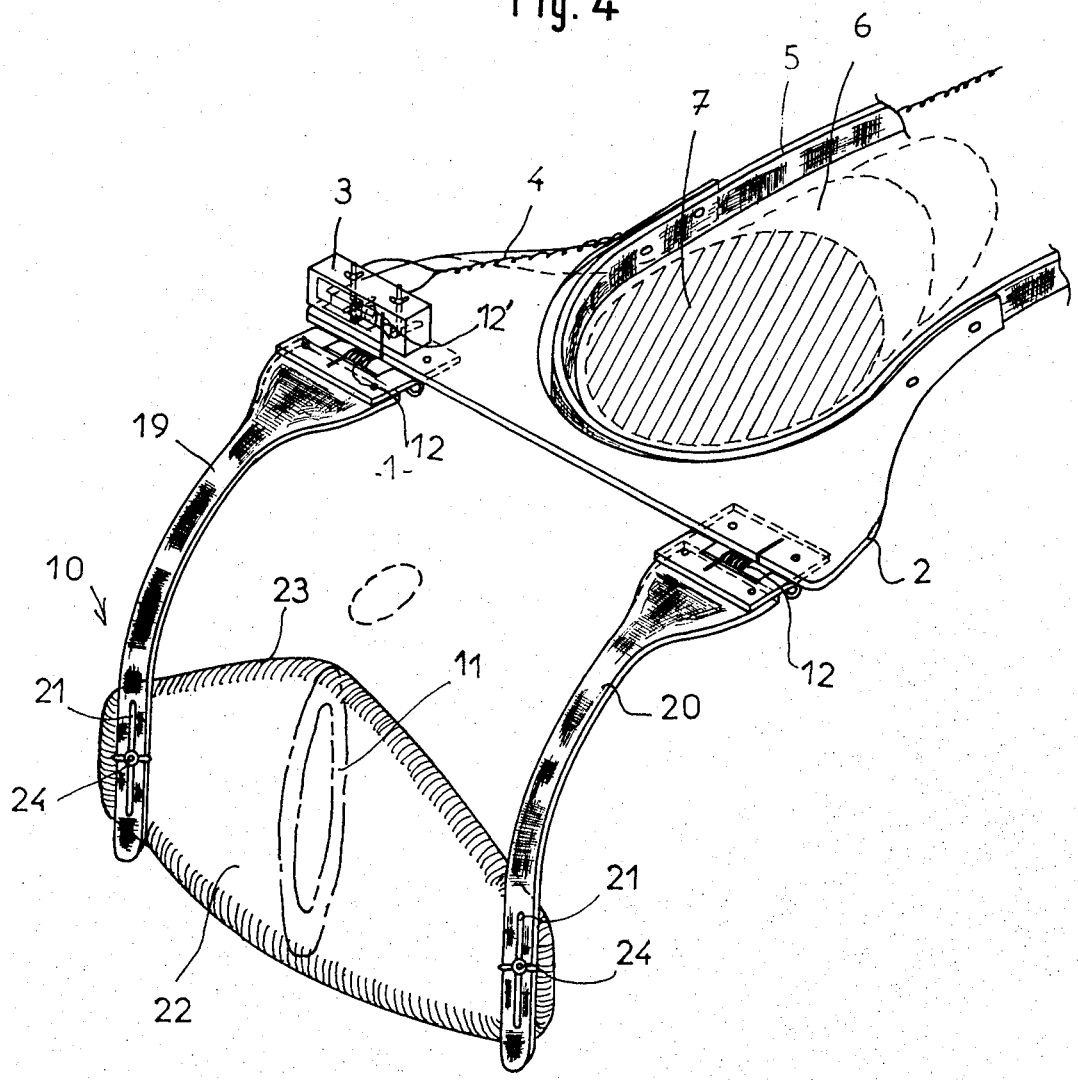
FIG. 4 shows a perspective diagrammatic view of a second embodiment of a parturition warning device in accordance with the invention.
Figure 5:
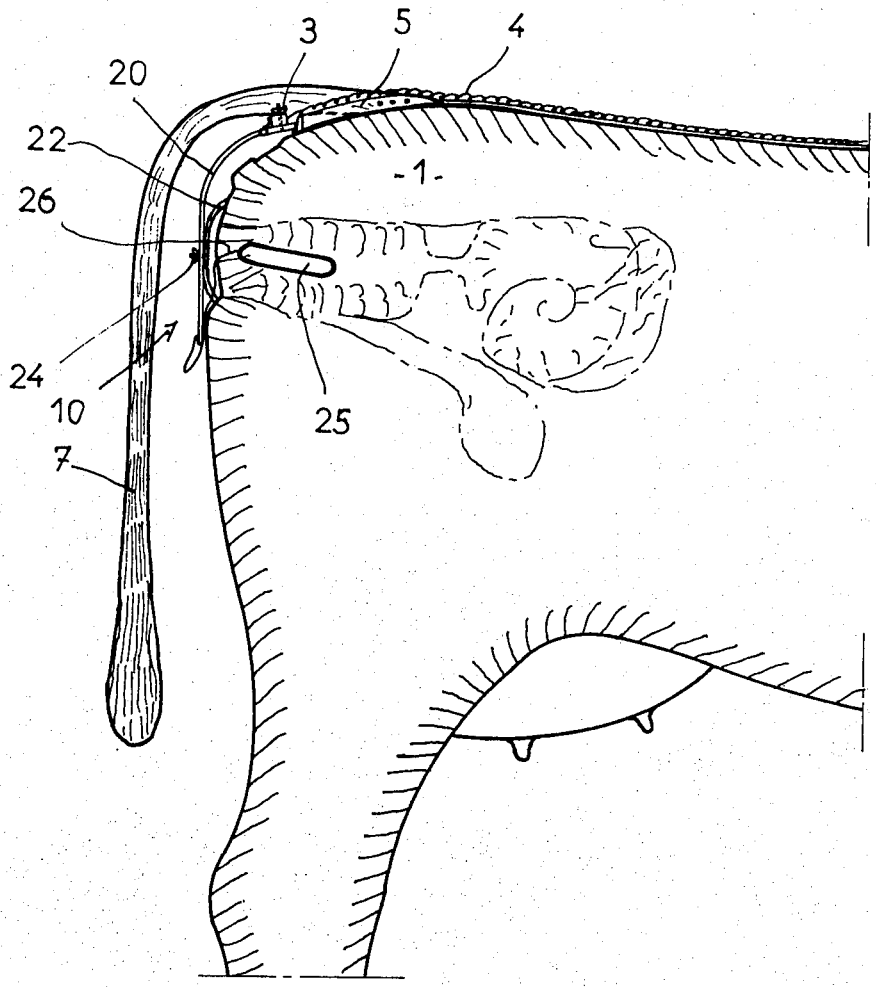
FIG. 5 shows a diagrammatic side view of a cow fitted with a parturition warning device of the type shown in FIG. 4.

The second embodiment of the invention shown in FIGS. 4 and 5 differs from the first embodiment only in the general arrangement of the first member 2 and the construction of the second member 10, and for this reason reference numerals common to both embodiments relate to substantially identical parts operating in an identical manner.

As may be seen in FIG. 4, the device is fixed on the spine of a cow 1 by a crupper strap 5 having an oblong hole 6 through which the tail 7 of cow 1 passes. The first member 2 is secured to the strap 5 or defines that part of the strap 5 fitting beneath the animal's tail. A second member 10 is pivotally suspended from the first member 2 and by swinging upwards serves to actuate, by means of a limb 12' formed by one end of a coil spring 12, the snap contact (not shown) of the electrical switch 3, which is connected by conductors 4 to an alarm arrangement, such as the arrangement shown in FIG. 3.

The member 10 comprises two arms 19 and 20 pivotally attached to member 2 via hinges and the arms are urged downwardly by the springs 12.

The arms 19 and 20 are provided with longitudinal slots 21, and a vulva contacting member 22 includes screw members which pass through the slots 21 and have wing nuts 24 thereon and by which member 22 is firmly attached to arms 19 and 20.

The member 22 is made from a rigid material, such as metal or rigid plastics material, and may be continuous but is preferably perforated to allow evaporation of body fluids between member 22 and the parts of the animal covered by member 22.

The member 22 extends between arms 19 and 20, covering the entire vulva and having a surface area sufficient to cover the vagina in full dilatation to ensure that in the event of perforation of the amniotic sac, the feet of the young animal, must strike against the member 22 to trigger the parturition warning signal without damage to the young animal.

The member 22 preferably has an anatomical shape adapted to the pregnant animal, this anatomy varying from one type of animal to another, and being notably different, for example, in the case of a mare and a cow. The upper regions of the member 22 are provided with a chamfer 23 or a rounded edge, having a large radius of curvature, to allow sliding of excrement thereover without adhesion thereto. The position of chamfer 23 is positioned in a precise manner between the anus and the upper portion of the vulva by adjusting the height of the member 22 on the arms 19 and 20, by means of the screws and wing-screw fasteners 24.

FIG. 5 illustrates use of an intermediary pressing insert member 25 which may be used to transmit the pressure of the amniotic sac as it is expelled to the second member 10.

This insert member 25 is tightly inserted in the vagina of the animal and may be fixed by a cord 26 to the second member 10 or to any part of the device, for example first element 2, for easy recuperation after expulsion.

The body 25 may be made of rubber or plastics material having the required suppleness and impermeability.

While the present invention has been described by way of example with reference to specific embodiments, many modifications and variations will be apparent to persons skilled in the art.

Thus, instead of using an electrical cable to connect the electrical switch to the alarm arrangement, a Hertzian emitter can be used. Similarly, instead of a simple contact electrical switch other forms of electrical switches, for example photoelectric cells or electroresistant probes, may be used and of course it is always possible to connect several switches, each attached to one animal, to a single alarm arrangement whereby actuation of any one of the switches will actuate the alarm.

Furthermore, the insert member 25 may have any desired shape and can be of a length calculated not to transmit the pressure to the second member until after the passage into the vagina of a significant portion of the amniotic sac.

I claim:

1. An animal parturition warning device comprising:

a crupper strap including a portion adapted to be passed under the tail of an animal;

a first member fixedly attached to said crupper strap for stable location beneath the tail but above the anus of the animal;

a second member depending from said first member and displaceable relative thereto about a pivotal axis alternatively in a first direction toward the animal and in a second direction away from the animal, said second member, when moved toward the animal, completely covering the vulva of the animal;

coil spring means, concentric with said pivotal axis between said first member and said second member, for constantly biasing said second member relative to said first member in said first direction into contact with the animal;

said second member being displaced relative to said first member in said second direction against the biasing force of said coil spring means by a positive issue from the vulva of the animal in the early stages of birth;

electrical switch means, positioned to be actuated by the displacement of said second member in said second direction, for detecting the early stages of birth and for activating an alarm system indicative thereof; and said coil spring means including at least a first straight limb engaging said second member and a second straight limb engaging an actuating member for said electrical switch means, the arrangement being such that pivotal displacement of said second member in said second direction away from the vulva of the animal increases the tension in said coil spring means and thereby the force applied to said actuating member for said electrical switch means.

2. A device according to claim 1, wherein said electrical switch means is mounted on said first member.

3. A device according to claim 1, wherein said second member comprises a vulva covering member supported from said first member on two substantially parallel arms.

4. A device according to claim 3, further comprising means for adjusting the location of said vulva covering member relative to said first member in the length direction of said arms.

5. A device as claimed in claim 1, wherein said second member is made from a rigid solid or preforated metal or plastics material.

6. A device according to claim 1, in combination with an alarm arrangement, and wherein said electrical switch means of the said device when actuated completes an electrical circuit for said alarm arrangement.

7. The combination set forth in claim 6, wherein said alarm arrangement includes a visual alarm and/or an audible alarm.

8. An animal parturition warning device comprising:

a crupper strap including a portion adapted to be passed under the tail of an animal;

a first member fixedly attached to said crupper strap for stable location beneath the tail but above the anus of the animal;

a second member depending from said first member and displaceable relative thereto alternatively in a first direction toward the animal and in a second direction away from the animal, said second member, when moved toward the animal, having a size and being arranged to cover both the vulva and the anus of the animal;

resilient means, between said first member and said second member, for constantly biasing said second member relative to said first member in said first direction into contact with the animal;

said second member being displaced relative to said first member in said second direction against the biasing force of said resilient means by a positive issue from the vulva of the animal in the early stages of birth; and electrical switch means, positioned to be actuated by the displacement of said second member in said second direction, for detecting the early stages of birth and for activating an alarm system indicative thereof.

9. A device according to claim 8, further comprising means for attaching said second member to the upper regions of the tail of the animal.

10. An animal parturition warning device comprising:

a crupper strap including a portion adapted to be passed under the tail of an animal;

a first member fixedly attached to said crupper strap for stable location beneath the tail but above the anus of the animal;

a second member depending from said first member and displaceable relative thereto alternatively in a first direction toward the animal and in a second direction away from the animal, said second member, when moved toward the animal, completely covering the vulva of the animal, said second member comprising a vulva covering member supported from said first member on two substantially parallel arms, said vulva covering member being chamfered, curved, or otherwise reduced in thickness at its upper edge;

resilient means, between said first member and said second member, for constantly biasing said second member relative to said first member in said first direction into contact with the animal;

said second member being displaced relative to said first member in said second direction against the biasing force of said resilient means by a positive issue from the vulva of the animal in the early stages of birth; and electrical switch means, positioned to be actuated by the displacement of said second member in said second direction, for detecting the early stages of birth and for activating an alarm system indicative thereof.

11. An animal parturition warning device comprising:

a crupper strap including a portion adapted to be passed under the tail of an animal;

a first member fixedly attached to said crupper strap for stable location beneath the tail but above the anus of the animal;

a second member depending from said first member and displaceable relative thereto alternatively in a first direction toward the animal and in a second direction away from the animal, said second member, when moved toward the animal, completely covering the vulva of the animal, said second member comprising a vulva covering member supported from said first member on two substantially parallel arms, said vulva covering member having a concave contact surface directed toward the vulva of the animal;

resilient means, between said first member and said second member, or constantly biasing said second member relative to said first member in said first direction into contact with the animal;

said second member being displaced relative to said first member in said second direction against the biasing force of said resilient means by a positive issue from the vulva of the animal in the early stages of birth; and electrical switch means, positioned to be actuated by the displacement of said second member in said second direction, for detecting the early stages of birth and for activating an alarm system indicative thereof.

12. An animal parturition warning device comprising:

a crupper strap including a portion adapted to be passed under the tail of an animal;

a first member fixedly attached to said crupper strap for stable location beneath the tail but above the anus of the animal;

a second member depending from said first member and displaceable relative thereto alternatively in a first direction toward the animal and in a second direction away from the animal, said second member, when moved toward the animal, completely covering the vulva of the animal, said second member comprising a vulva covering member supported from said first member on two substantially parallel arms, said vulva covering member being shaped to make pressure contact with the perineal region of the animal;

resilient means, between said first member and said second member, for constantly biasing said second member relative to said first member in said first direction into contact with the animal;

said second member being displaced relative to said first member in said second direction against the biasing force of said resilient means by a positive issue from the vulva of the animal in the early stages of birth; and electrical switch means, positioned to be actuated by the displacement of said second member in said second direction, for detecting the early stages of birth and for activating an alarm system indicative thereof.

13. An animal parturition warning device comprising:

a crupper strap including a portion adapted to be passed under the tail of an animal;

a first member fixedly attached to said crupper strap for stable location beneath the tail but above the anus of the animal;

a second member depending from said first member and displaceable relative thereto alternatively in a first direction toward the animal and in a second direction away from the animal, said second member, when moved toward the animal, completely covering the vulva of the animal;

resilient means, between said first member and said second member, for constantly biasing said second member relative to said first member in said first direction into contact with the animal;

said second member being displaced relative to said first member in said second direction against the biasing force of said resilient means by a positive issue from the vulva of the animal in the early stages of birth;

electrical switch means, positioned to be actuated by the displacement of said second member in said second direction, for detecting the early stages of birth and for activating an alarm system indicative thereof; and an insert member intended to be inserted within the vagina of the animal and to displace said second member in said second direction to a position whereat said electrical switch means is actuated after a predetermined movement of the amniotic sac down the vagina.

14. The combination set forth in claim 13, wherein said insert member comprises a cylindrical body with hemispherical ends of such dimensions as to fill the vaginal cavity without risk of expulsion by vulva contractions.

15. The combination set forth in claim 13, wherein said insert member comprises a resilient body covered by an impermeable skin or film.

16. An animal parturition warning device comprising:

a crupper strap including a portion adapted to be passed under the tail of an animal;

a first member fixedly attached to said crupper strap for stable location beneath the tail but above the anus of the animal;

a second member depending from said first member and displaceable relative thereto alternatively in a first direction toward the animal and in a second direction away from the animal, said second member, when moved toward the animal, completely covering the vulva of the animal;

resilient means, between said first member and said second member, for constantly biasing said second member relative to said first member in said first direction into contact with the animal;

said second member being displaced relative to said first member in said second direction against the biasing force of said resilient means by a positive issue from the vulva of the animal in the early stages of birth;

electrical switch means, positioned to be actuated by the displacement of said second member in said second direction, for detecting the early stages of birth and for activating an alarm arrangement indicative thereof; and said alarm arrangement having an electrical circuit including a delay device intended to be fully operated only after said electrical switch means has been closed, and remained closed, for a predetermined period of time, said delay device comprising an adjustable timing delay and said predetermined period comprising a period of time longer than the normal time for the defecation of the animal.

* * * * *